United States Patent [19]

Ozone et al.

[11] Patent Number: 4,527,356

[45] Date of Patent: Jul. 9, 1985

[54] CAM GRINDING MACHINE

[75] Inventors: Takashi Ozone, Kodaira; Shohei Hayakawa, Hidaka; Fusao Nakajima, Sayama; Keiichi Yamada, Hidaka; Kazuo Araki, Sayama, all of Japan

[73] Assignee: Honda Giken Kogyo Kabushiki Kaisha, Tokyo, Japan

[21] Appl. No.: 517,036

[22] Filed: Jul. 25, 1983

[30] Foreign Application Priority Data

Jul. 23, 1982 [JP] Japan ..... 57-127568
Oct. 6, 1982 [JP] Japan ..... 57-174662

[51] Int. Cl.[3] ..... B24B 17/02

[52] U.S. Cl. ..... 51/101 R; 51/281 C; 409/98; 409/114

[58] Field of Search ..... 51/101 R, 101 LG, 97 NC, 51/105 EC, 105 SP, 127, 165.71, 165.89, 281 C; 409/6, 98, 111, 112, 114, 122, 123

[56] References Cited

U.S. PATENT DOCUMENTS 1,017,879 2/1912 Landis ..... 51/101 R
2,336,201 12/1943 Walker ..... 51/101 R X
2,553,831 5/1951 Musyl ..... 51/101 R
3,864,879 2/1975 Naismith ..... 51/101 R
3,943,664 3/1976 Broide et al. ..... 51/101 R X
4,262,454 4/1981 Iida et al. ..... 51/101 R X

FOREIGN PATENT DOCUMENTS 56-8740 2/1981 Japan .

*Primary Examiner*—Robert P. Olszewski
*Attorney, Agent, or Firm*—Armstrong, Nikaido, Marmelstein & Kubovcik

[57] ABSTRACT

A cam grinding machine which includes a machine frame, a turning grinding wheel adjacent the frame, a swingable table positioned opposite to the frame, and a turnable work shaft for holding a workpiece mounted on the table. The table is controlled in the swing movement by a touch roller device mounted on the table and a master cam device mounted on the frame. The touch roller device is disposed to face and contact the master cam device so that the workpiece may be ground in correspondence to the master cam device by the grinding wheel provided on the forward side of forward and rearward swing direction of the table. The master cam device includes a driving shaft which is turned synchronously with the turning of the work shaft and is adjustable in its turning phase in relation to the work shaft.

4 Claims, 6 Drawing Figures

CAM GRINDING MACHINE

BACKGROUND OF THE INVENTION

This invention relates to a cam grinding machine used chiefly for working on a workpiece having plural cam blocks for producing a valve driving cam shaft of an internal combustion engine or the like.

Grinding machines have been known which include a swingable table provided thereon with a turnable work shaft for holding a workpiece. The table is arranged to be controlled in its swing movement by a touch roller means and a master cam means which are disposed to face one another between the table and a machine frame. The machine frame is provided opposed to the table so that the workpiece may be ground by a turning grinding wheel which is disposed on the forward side in the forward and rearward swing direction of the table. It has been usual with this type of machine that the master cam means is provided on the table so as to be turnable synchronously with the turning of the work shaft, and the touch roller means is provided on the machine frame. It has been usually practiced with this arrangement that, when the workpiece having plural cam blocks different in phase from each other is to be ground, a master cam means composed of plural master cam members corresponding in phase to the respective cam blocks is used. The respective cam blocks are ground one by one by bringing the respective master cam members of the master cam means one by one into contact with the touch roller means. This however, is inconvenient in the following points:

(i) The same number of the master cam members as that of the cam blocks of the workpiece is required, so that it takes much trouble and time to manufacture the master cam members.

(ii) As a result of the fact that the plural master cam members are mounted on the swingable table, the swing inertia weight of the table is increased. If the grinding is carried out at a high speed, there occurs a jumping phenomenon because of a delay in swing movement of the table.

In order to decrease the number of the master cam members mounted on the swingable table, another grinding machine is known wherein the master cam shaft is connected to the work shaft through a phase adjacent mechanism such as a rotary actuator or the like so that grinding of plural cam blocks of the workpiece different in phase may be carried out using a single common master cam member by means of a phase adjustment of the cam shaft. (See Japanese Patent Publication Sho. No. 56-8740). In this type of machine, the foregoing first inconvenience can be removed, but the foregoing second inconvenience cannot be removed, because the weight of the phase adjustment mechanism is added to the table swing inertia weight. In addition, there is brought about a third inconvenience wherein when the workpiece is changed to a different kind of one, both the master cam means and the work shaft connected thereto through the phase adjustment mechanism are required to be replaced. Consequently, it takes much trouble and time to replace them. This is not suitable especially for production of worked products of various kinds with each kind being produced on a small scale.

OBJECTS AND SUMMARY OF THE INVENTION

The present invention has as an object the reduction of the number of master cam members needed for producing cams from the cam blocks of the workpiece.

A further object of the present invention is the reduction of the swing inertia weight of the swingable table and elimination of the jumping phenomenon when grinding at high speed.

A still further object of the present invention is to provide a structure which is simple and easy to change when the workpiece is changed to a different kind of workpiece.

This invention is a grinding machine which includes a machine frame, a turning grinding wheel adjacent the frame, a swingable table positioned opposite to the frame, a turnable work shaft for holding a workpiece mounted on the table, the table being controlled in its swing movement by a touch roller means and a master cam means which are disposed to face one another between the table and the machine frame so that the workpiece may be ground by the turning grinding wheel provided on the forward side in a forward and rearward swing direction of the table. The invention is characterized in that the touch roller means is provided on the table, the master cam means is provided on the machine frame, and a driving shaft for the master cam means is adapted to be turnable synchronously with the turning of the work shaft and to be adjustable in its turning phase in relation to the work shaft.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
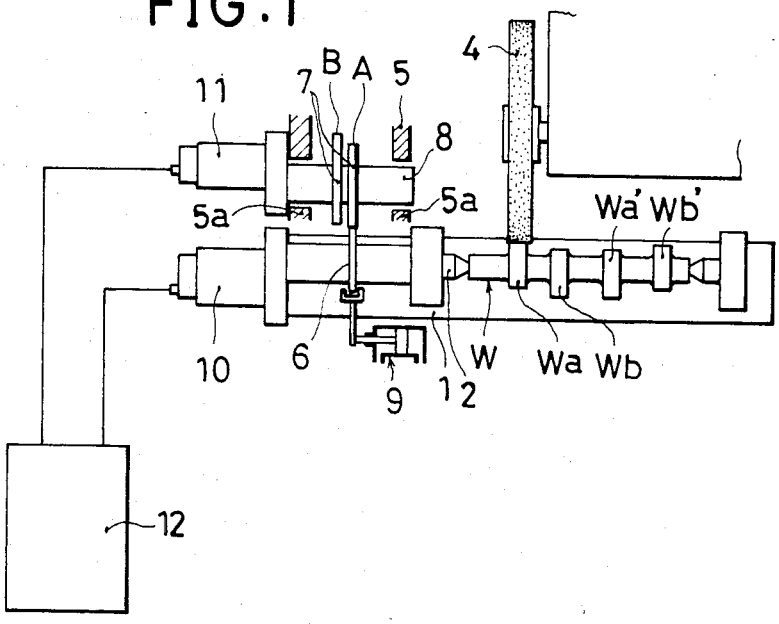
Fig. 1 is a schematic top plan view of the embodiment of this invention.
Figure 2:
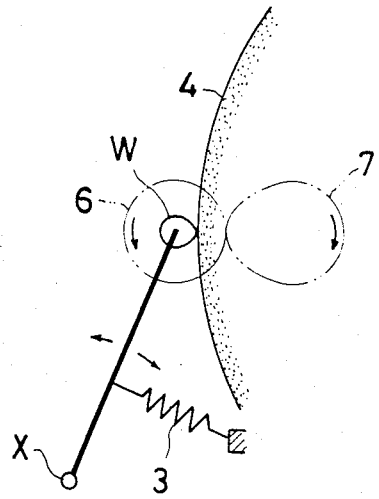
FIG. 2 is a diagram for explaining relations between a workpiece and a turning grinding wheel and those between a touch roller means and a master cam means.
Figure 3:
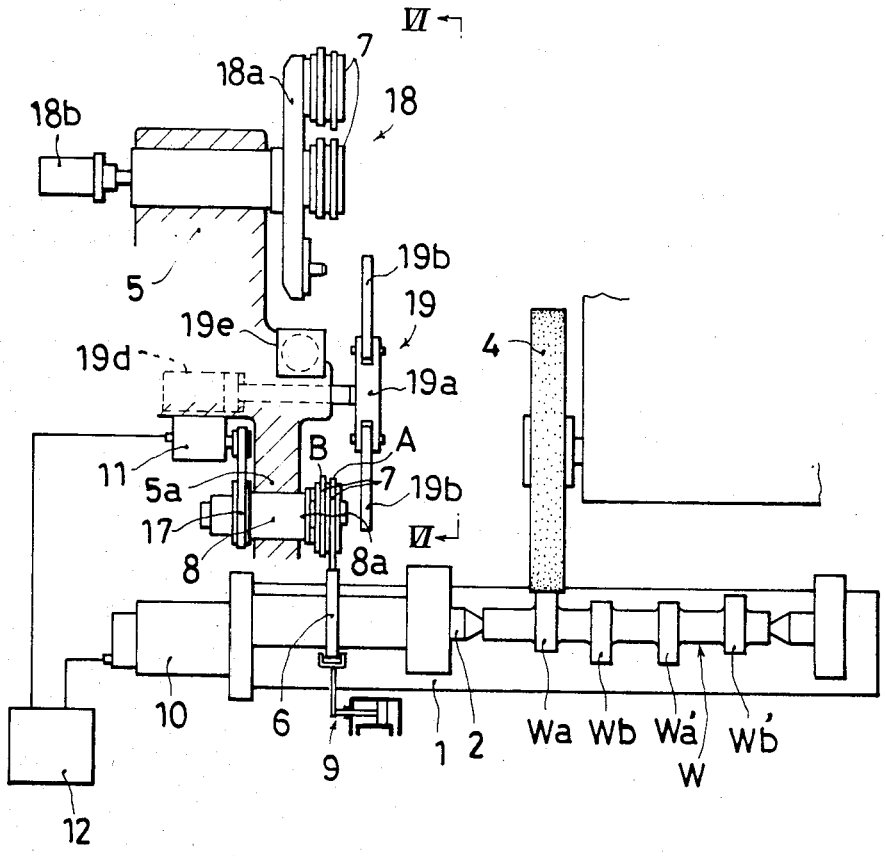
FIG. 3 is a top plan view of another embodiment of this invention.
Figure 4:
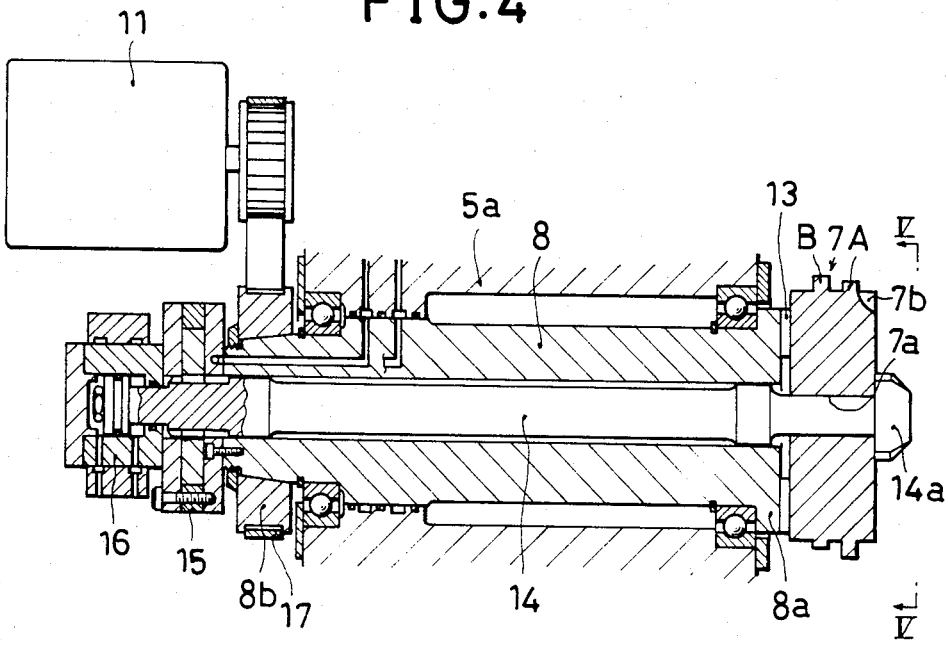
FIG. 4 is a sectional view of a cam shaft section thereof.
Figure 5:
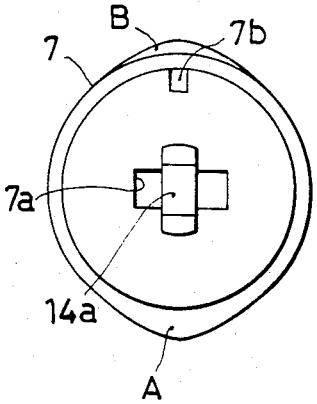
FIG. 5 is a side view of the master cam means thereof viewed from the line in V—V in FIG. 4.
Figure 6:
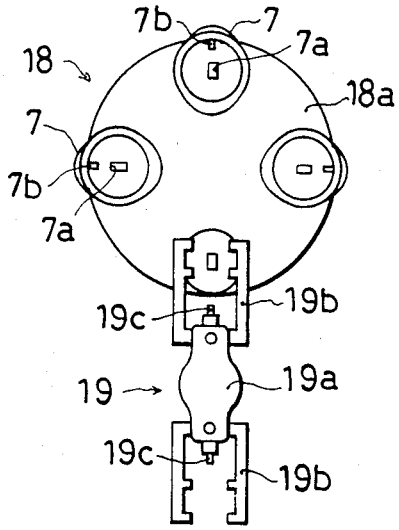
FIG. 6 is a side view of a master cam replacement means section thereof viewed from the line VI—VI in FIG. 3.

Embodying examples of this invention will be explained with reference to the accompanying drawings:

FIGS. 1 and 2 show an embodying example for grinding a valve driving cam shaft for a two-cylinder engine which has a pair of intake valve cam blocks Wa, Wa' and a pair of exhaust valve cam blocks Wb, Wb'.

Referring to these Figures, swingable table 1 has thereon a work shaft 2 for holding the workpiece W. The table 1 is arranged to be swingable forwards and rearwards about a pivot point X as shown in FIG. 2, and also is arranged to be biassed in the forward direction by a spring 3, at the time of working, so that the workpiece W and a turning grinding wheel 4 in front of the workpiece may be brought into contact with each other. At the same time, a touch roller means 6 and a master cam means 7 which are disposed to face one another between the table 1 and a machine frame 5 in front of the table 1 may be brought into contact with each other.

According to this invention, the touch roller means 6 is provided on the table 1 and the master cam means 7 is provided on the machine frame 5. More in detail, as in the illustrated example, the master cam means 7 can comprise two kinds of master cam members 7A and 7B which are different in shape one from another and correspond to the respective intake valve and exhaust valve cam blocks Wa and Wb, different in phase from each other. The master cam members 7A, 7B are mounted on a common cam driving shaft 8 side by side. The touch roller 6 is provided coaxially with the work shaft 2 so as to be axially movable by means of a spline engagement or the like. The touch roller means 6 is also adapted to be selectively movable by a shift mechanism 9 to any predetermined position facing either one or the other of the respective master cam members 7A, 7B.

A workpiece driving motor 10 is provided for turning the work shaft 2. A master cam driving motor 11 is provided for turning the driving shaft 8. The motors 10, 11 can comprise pulse motors, for instance. The work shaft 2 and the driving shaft 8 may be turned synchronously by arranging the two motors 10, 11 to be synchronously driven by driving pulses from a control means 12. Additionally, the driving shaft 8 can be arranged so as to have its turning phase in relation to the work shaft 2 adjusted by driving only the master cam driving motor 11.

Next, the operation of the foregoing example machine will be explained as follows:

First, the turning grinding wheel 4 is moved to a position facing the left side intake valve cam block Wa of the workpiece W. The touch roller means 6 is shifted to a position facing the master cam member 7A for the intake valve cam block Wa. The swingable table 1 is then urged to be inclined forwards. A predetermined portion of the cam block Wa is ground to a predetermined depth by the grinding wheel 4, and the touch roller means 6 is then brought into contact with the master cam member 7A. Next, the work shaft 2 and the driving shaft 8 are turned synchronously. The cam block Wa is ground to be formed into a cam corresponding to the master cam member 7A through swing movements of the table 1 following the master cam member 7A.

After completion of the grinding work, the table 1 is swung to be inclined rearwards, and the turning grinding wheel 4 is moved to a position facing the exhaust valve cam block Wb. The touch roller means 6 is shifted to a position facing the master cam member 7B. Thereafter, the table 1 is again swung to be inclined forwards in almost the same manner as above, and the cam block Wb is ground to be shaped as a cam corresponding to the master cam member 7B.

Thus, the grinding of the one pair of the intake valve and exhaust valve cam blocks Wa, Wb can be performed in the manner described above. The other pair of the intake valve and exhaust valve cam blocks Wa, Wb' are worked on next, but because they have a phase difference of 180 degrees from the first pair of cam blocks, the driving shaft 8 is turned by 180 degrees in relation to the work shaft 2 so as to be adjusted in phase to the other pair. Thereafter, almost the same operations as above are carried out and the grinding of the respective cam blocks Wa, Wb' is performed. Thus, as illustrated in the foregoing example, the movable part of the apparatus need only comprise the table 1 provided thereon with the work shaft 2, the single common touch roller means 6 coaxial therewith and the shift mechanism 9 can be an extremely simple and small one sufficient to give an axial directional slight shift movement to the touch roller means 6. The same can be constructed to be much smaller in size and weight than the phase adjustment mechanism such as the rotary actuator or the like used in the machine disclosed in Japan Patent Publication Sho No. 56-8740. Consequently, the table 1 can be decreased remarkably in its swing inertia weight. As a result, even if the turning speed of the driving shaft 8 is increased, jumping does not occur, and the grinding can be carried out at a high speed.

If all of the cam blocks of the workpiece W are identical in shape, the master cam means 7 may comprise a single master cam member. The shift mechanism 9 for the touch roller means 6 would be unnecessary.

When the workpiece to be prepared is changed to a different kind of one, only the master cam means 7 on the machine frame 5 is replaced. It is not necessary to replace any of the members provided on the swingable table 1. Thus, the grinding machine can easily meet many different requirements.

In the example shown in FIG. 1, the master cam means 7 is positioned at a middle portion of the driving shaft 8 between its bearing portions 5*a*, 5*a* on both ends of the shaft 8. It is inevitable that the bearing portions 5*a*, 5*a* are disassembled when a replacement of the master cam means 7 is desired. In order to make it possible to replace the master cam means 7 without involving such a disassembly as above, there is proposed a second embodying example shown in FIGS. 3 to 6. In this embodiment, the master cam means 7 is mounted on a free end portion 8*a* of the driving shaft 8 which protrudes outwardly from the bearing portion 5*a* of the shaft 8. The master cam means is then axially detachable from the shaft 8.

More in detail, in the illustrated example, the master cam means 7 comprises an integrally combined master unit having the foregoing two kinds of master cam members 7A, 7B. As shown clearly in FIG. 4, the means 7 is brought in engagement with an end surface of the free end portion of 8*a* of the shaft 8 through a joint 13 comprising engaging projections formed on the end surface of the free end portion 8*a* and engaging projections formed on an end surface of the master cam means 7. The master cam means 7 cannot be rotated in relation to the free end portion 8*a*, and is fixed thereto by a lock means. The lock means can comprise, for instance, rod 14 piercing through the shaft 8 and having at its outwardly protruded end portion a T shaped lock member 14*a*. The master cam member 7 is brought into engagement with the free end portion 8*a* and is fixed thereto through the lock member 14*a* by inserting the lock member 14*a* through a center square opening 7*a* of the master cam means 7 and turning the rod 14 by 90 degrees to cross the opening 7*a*. The rod 14 is retreated to the left in FIG. 4 to its position shown therein. A turning type fluid actuator 15 and an advancing and retreating cylinder 16 are provided on the base end portion of the rod 14 for performing these movements. If, on the other hand, the pressure contact of the lock member 14*a* with the master cam means 7 is released by the advance movement of the rod 14 and the rod 14 is turned by 90 degrees in the reverse direction to the above, the lock member 14*a* is brought to be in coincidence with the square opening 7*a*, and thus the master cam means 7 can be removed therefrom in the axial direction of the rod 14. The shaft B is connected at a timing pulley 8*b* provided on its base end portion to the foregoing master cam driving motor 11 through a belt 17.

Referring to the drawings, a stock means 18 for the plural master cam means 7 is provided on one side of the shaft 8 so that one master cam means 7 on the stock means 18 and the master cam means 7 on the shaft 8 are replaceable one with another through an intermediate replacement means 19 interposed between the stock means 18 and the shaft 8.

More in detail, the stock means 18 has an index table 18*a* rotatably supported on a shaft which is in parallel with the shaft 8. A plurality of master cam means 7 are mounted circumferentially at regular intervals and supported detachably on respective holding pins of the index table 18*a* as shown clearly in FIG. 6. The replacement means 19 has a rotary frame 19*a* which is supported on a shaft that is parallel with the shaft 8 and is axially movable to advance and retreat. The rotary frame 19*a* is provided with a pair of clamp members 19*b*, 19*b* for clamping one of the master cam means 7 located at a predetermined index position of the index table 18*a* and the master cam means 7 on the shaft 8.

When the workpiece W is changed to a new one which is different in kind therefrom, the index table 18*a* is turned so that the master cam means 7 corresponding to the new workpiece W to be worked upon may be moved to the index position. In this condition, the rotary frame 19*a* is retreated and the master cam means 7 at the index position and the used master cam means 7 on the shaft 8 are clamped by the respective clamp members 19*b*, 19*b*, and thereafter the rotary frame 19*a* is advanced, so that those master cam means 7, 7 are detached from the table 18*a* and the shaft 8. The rotary frame 19*a* is turned by 180 degrees and is retreated again, whereby the new master cam means 7 and the used master cam means 7 are mounted on the shaft 8 and the table 18*a*, respectively.

The rotary frame 19*a* is provided with a positioning pin 19*c* arranged to be brought into engagement with a cut-out 7*b* made in the periphery of each master cam means 7 for setting the phase thereof.

A driving motor 18*b* for the index table 18*a*, an advancing and retreating cylinder 19*d* for the rotary frame 19*a*, and a rack cylinder 19*e* for turning the rotary frame 19*a* complete the stock means and the replacement means.

Thus, according to this invention, the master cam means is provided on the machine frame, so that the swingable table can be decreased in its swing inertia weight. Accordingly, it makes it possible to work at a high speed. Additionally, a replacing operation of the master cams at the time of change in kind of the workpiece to be worked on can be facilitated.

It is readily apparent that the above-described cam grinding machine meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A cam grinding machine including a machine frame, a turning grinding wheel adjacent the frame, a swingable table positioned opposite to the frame, a turnable work shaft for holding a workpiece mounted on said table, the table being arranged to be controlled in its swing movement by a touch roller means and a master cam means which are disposed to face one another between the table and the machine frame so that the workpiece may be ground by the turning grinding wheel which is provided on the forward side in the forward and rearward swing direction of the table, characterized in that the touch roller means is provided on the table, the master cam means is provided on the machine frame, and a driving shaft for the master cam means is adapted to be turnable synchronously with turning of the work shaft also to be adjustable in its turning phase in relation to the work shaft, said master cam means being mounted on a free end portion of the driving shaft that projects outwards from a bearing portion thereof so as to be detachable therefrom in its axial direction, a stock means for other master cam means is provided on one side of the driving shaft so that the other master cam means on the stock means and the master cam means on the driving shaft are replaceable one with another through an intermediate replacement means.

2. The cam grinding machine of claim 1, wherein the stock means has an index table supported on a shaft in parallel with the driving shaft, and a plurality of said other master cam means are so supported on the index table as to be detachable therefrom in the axial direction thereof, and the replacement means has a rotary frame which is supported on a shaft in parallel with the driving shaft and is arranged to be movable to advance and retreat in the axial direction thereof, and the rotary frame is provided thereon with a pair of clamp members for clamping, respectively, one of the other master cam means located at a predetermined index position on the index table and the master cam means on the driving shaft.

3. A cam grinding machine including a machine frame, a turning grinding wheel adjacent the frame, a swingable table positioned opposite to the frame, a turnable work shaft for holding a workpiece mounted on said table, the table being arranged to be controlled in its swing movement by a touch roller means and a master cam means which are disposed to face one another between the table and the machine frame so that the workpiece may be ground by the turning grinding wheel which is provided on the forward side in the forward and rearward swing direction of the table, characterized in that the touch roller means is provided on the table, the master cam means is provided on the machine frame, and a driving shaft for the master cam means is adapted to be turnable synchronously with turning of the work shaft also to be adjustable in its turning phase in relation to the work shaft, said master cam means including plural master cam members which are different in shape one from another and disposed side by side, and the touch roller means is movable to be positioned at any selective position facing any predetermined one of the respective master cam members, said master cam means being mounted on a free end portion of the driving shaft that projects outwards from a bearing portion thereof so that the master cam means thereof is detachable therefrom in its axial direction, and a stock means for other master cam means is provided on one side of the driving shaft with said other master cam means also including plural master cam members so that the other master cam means on the stock means and the master cam means on the driving shaft are replaceable with one another through an intermediate replacement means.

4. The cam grinding machine of claim 3, wherein the stock means has an index table supported on a shaft in parallel with the driving shaft, and a plurality of said other master cam means are so supported on the index table as to be detachable therefrom in the axial direction thereof, and the replacement means has a rotary frame which is supported on a shaft in parallel with the driving shaft and is arranged to be moveable to advance and retreat in the axial direction thereof, and the rotary frame is provided thereon with a pair of clamp members for clamping, respective, one of the other master cam means located at a predetermined index position on the index table and the master cam means on the driving shaft.

* * * * *